US011015386B2

(12) United States Patent
Wang

(10) Patent No.: US 11,015,386 B2
(45) Date of Patent: May 25, 2021

(54) SAFETY GATE

(71) Applicant: DEMBY DEVELOPMENT CO., LTD., New Taipei (TW)

(72) Inventor: Tsung-Hsiang Wang, New Taipei (TW)

(73) Assignee: DEMBY DEVELOPMENT CO., LTD., New Taipei (TW)

( * ) Notice: Subject to any disclaimer, the term of this patent is extended or adjusted under 35 U.S.C. 154(b) by 111 days.

(21) Appl. No.: 16/541,353

(22) Filed: Aug. 15, 2019

(65) Prior Publication Data

US 2020/0063488 A1 Feb. 27, 2020

(30) Foreign Application Priority Data

Aug. 21, 2018 (CN) ..... 201821351607.4

(51) Int. Cl.

| | |
|---|---|
| ***E06B 9/04*** | (2006.01) |
| ***E06B 9/02*** | (2006.01) |
| ***E05B 65/00*** | (2006.01) |
| *E06B 9/00* | (2006.01) |

(52) U.S. Cl.

CPC ..... *E06B 9/04* (2013.01); *E05B 65/0007* (2013.01); *E06B 9/02* (2013.01); *E06B 2009/002* (2013.01)

(58) Field of Classification Search

CPC ..... E06B 9/04; E06B 9/02; E06B 2009/002; E05B 65/0007

See application file for complete search history.

(56) References Cited

U.S. PATENT DOCUMENTS

| | | | | |
|---|---|---|---|---|
| 4,702,036 | A * | 10/1987 | Johnson | E06B 9/02 49/394 |
| 4,831,777 | A * | 5/1989 | Johnson, Jr. | E06B 9/02 160/228 |
| 5,282,606 | A * | 2/1994 | Praiss | E04H 17/18 256/26 |
| 5,664,371 | A * | 9/1997 | Berliner | E06B 9/02 160/351 |
| 6,978,576 | B2 * | 12/2005 | Shirk | E05D 3/022 220/908 |
| 7,887,029 | B2 * | 2/2011 | Flannery | E06B 9/06 256/73 |

(Continued)

*Primary Examiner* — Justin B Rephann

(74) *Attorney, Agent, or Firm* — Alan D. Kamrath; Karin L. Williams; Mayer & Williams PC

(57) ABSTRACT

A safety gate has two wall-mounted post assemblies, a main frame, and two connecting assemblies. The two wall-mounted post assemblies are mounted to two walls of an entrance. The main frame has two frame portion. The two frame portion can pivot with respect to each other. The two connecting assemblies are mounted on two sides of the main frame and detachably and pivotally connected to the wall-mounted post assemblies. A stopping assembly is elastically mounted on a side, near the main frame, of each wall-mounted post assembly and configured to limit one of the connecting assemblies. With such safety gate, a user can press either one of the stopping assemblies to withdraw into the wall-mounted post assembly, and the corresponding connecting assembly can be separated from the wall-mounted post assembly to open the safety gate. When the two stopping assemblies are pressed, the main frame can be detached.

19 Claims, 7 Drawing Sheets

(56) References Cited

U.S. PATENT DOCUMENTS

| | | | | |
|---|---|---|---|---|
| 8,713,851 | B2 * | 5/2014 | Flannery | E05B 65/0007 49/55 |
| 10,550,634 | B1 * | 2/2020 | Holland | E06B 9/04 |
| 10,697,236 | B2 * | 6/2020 | King | E06B 11/04 |
| 2006/0231821 | A1 * | 10/2006 | Gavin | E06B 11/02 256/73 |
| 2014/0007506 | A1 * | 1/2014 | Huang | E06B 3/32 49/149 |
| 2017/0211314 | A1 * | 7/2017 | Raffi | E06B 9/04 |
| 2019/0085620 | A1 | 3/2019 | Wang | |

* cited by examiner

SAFETY GATE

CROSS-REFERENCE TO RELATED APPLICATIONS

This application is based upon and claims priority under 35 U.S.C. 119 from China Patent Application No. 201821351607.4 filed on Aug. 21, 2018, which is hereby specifically incorporated herein by this reference thereto.

BACKGROUND OF THE INVENTION

1. Field of the Invention

The present invention relates to a safety gate.

2. Description of the Prior Arts

A safety gate is mounted at an entrance of a building for preventing passing through.

The conventional safety gate may be mounted on a wall-mounted post assembly via a fastening means, and the conventional fastening means may be a screwed fixture or fastening via binding. When someone wants to pass through the entrance, he needs to unfasten the fastening means and the wall-mounted post assembly, then fasten the fastening assembly on the wall-mounted post assembly again. Therefore, fastening and unfastening may consume a lot of time and effort, so it is not convenient for the user.

A conventional safety gate, CN 201721190203.7, is provided: A safety gate has a main frame, two wall-mounted assemblies, and two connecting assemblies. The two connecting assemblies are respectively and movably mounted on two opposite sides of the main frame. Each connecting assembly has a first connecting part and a second connecting part. Each wall-mounted assembly has a first pivot base and a second pivot base. Each first connecting part is rotatably and detachably connected to a corresponding first pivot base. Each second connecting part is rotatably and detachably connected to a corresponding second pivot base. By detaching and rotating one connecting assembly from the corresponding wall-mounted assembly, the main frame can be closed and opened as a gate. By detaching all the connecting parts from the corresponding bases, the main frame can be easily installed on and disassembled from a place.

To overcome the shortcomings, the present invention provides a safety gate to mitigate or obviate the aforementioned problems.

SUMMARY OF THE INVENTION

The main objective of the present invention is to provide a safety gate that is configured to be mounted at an entrance and thus block the entrance and is easy to be opened and detached.

The safety gate has two wall-mounted post assemblies, a main frame, two connecting assemblies, and two stopping assemblies. The two wall-mounted post assemblies are respectively mounted on two walls on two sides of the entrance. The two connecting assemblies are respectively mounted on two ends of the main frame. Each one of the connecting assemblies is detachably and rotatably connected to a corresponding one of the wall-mounted post assemblies. The two stopping assemblies are respectively mounted on the two wall-mounted post assemblies and respectively limit the two connecting assemblies. Each one of the stopping assemblies is mounted on a side, close to the main frame, of the corresponding wall-mounted post assembly. Each one of the stopping assemblies is capable of extending elastically in the corresponding wall-mounted post assembly thereby configured to limit the corresponding connecting assembly.

In the aforesaid safety gate, the connecting assemblies and the wall-mounted post assemblies are connected to each other pivotally and detachably and the main frame can be fixed on the wall-mounted post assemblies. After the connecting assemblies are mounted on the wall-mounted post assemblies, the stopping assemblies may extend out of the wall-mounted post assemblies and thereby limit positions of the connecting assemblies, thereby preventing the connecting assemblies from being separated from the wall-mounted post assemblies. In other words, the main frame is locked on the wall-mounted post assemblies and can block the entrance. Besides, as the first frame portion and the second frame portion are pivotal with respect to each other, the safety gate can be adapted to different walls or obstructs spaces by different widths. In addition, when the safety gate is opened, the first frame portion and the second frame portion can be folded to reduce occupied space. To pass through the entrance, the user only needs to press either one of the stopping assemblies to withdraw into the corresponding wall-mounted post assembly, then takes the corresponding connecting assembly off from the corresponding wall-mounted post assembly, and thus the main frame is separated from said wall-mounted post assembly and is capable of pivoting about the other wall-mounted post assembly, which opens the safety gate and allows anyone to pass through. When detaching the main frame, the user only needs to press both two stopping assemblies to withdraw the corresponding wall-mounted post assemblies, then take both two connecting assemblies from the corresponding wall-mounted post assemblies, and thus the main frame is separated from the two wall-mounted post assemblies. Therefore, the main frame is detached from the wall-mounted post assemblies completely. As a result, the safety gate is easy to be opened and detached.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
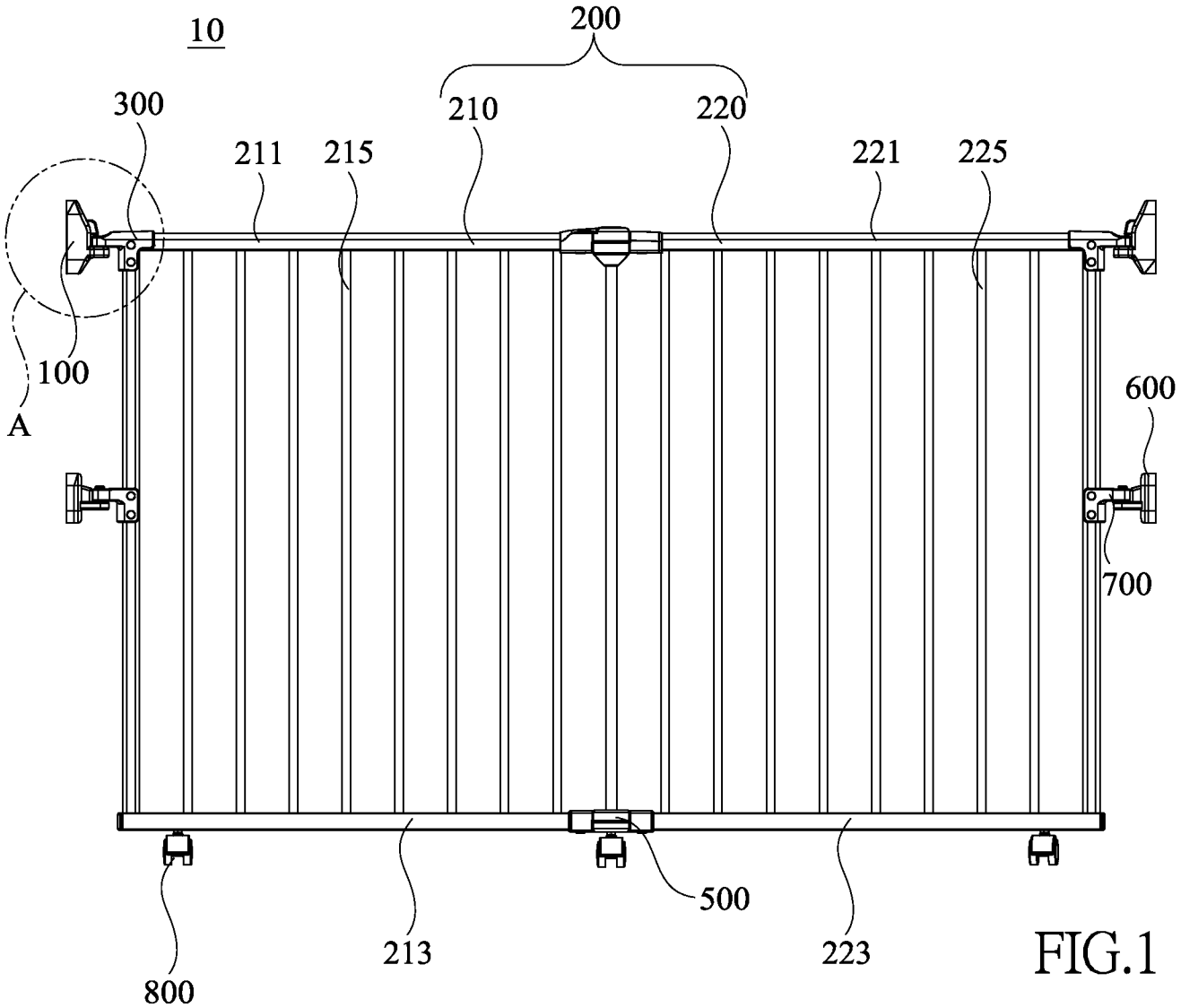
FIG. 1 is a perspective view of a safety gate in accordance with the present invention.

In order to facilitate the understanding of the present invention, the present invention will be described more fully hereinafter with reference to the accompanying drawings. A preferred embodiment of the present invention is shown in the drawings. However, the invention may be embodied in many different forms and is not limited to the embodiments described herein. Rather, these embodiments are provided so that this disclosure will be more fully understood.

It should be noted that when a component is referred to as being "fixed" to another component, it can be directly mounted on said another component or still another component may be disposed between the component and said another component. When a component is considered to be "connected" to another component, it can be directly connected to said another component or still another component may be disposed between the component and said another component. The terms "vertical," "horizontal," "left," "right," and the like, as used herein, are for the purpose of illustration and are not intended to be the only embodiment.

All technical and scientific terms used herein have the same meaning as commonly understood by one of ordinary skill in the art to the invention. The terminology used in the description of the present invention is for the purpose of describing particular embodiments and is not intended to limit the invention. The term "and/or" used herein includes any and all combinations of one or more of the associated listed items.

Figure 2:
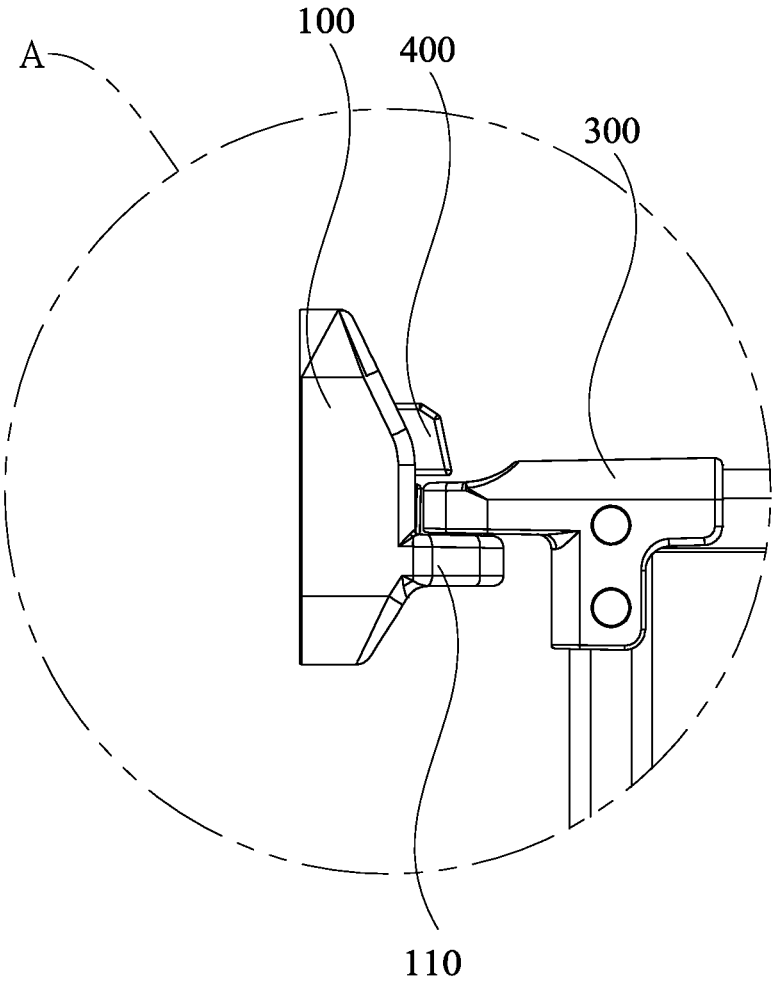
FIG. 2 is an enlarged view of the safety gate of a portion A in FIG. 1.

Please refer to FIG. 1. One of the embodiments of the safety gate 10 of the present invention comprises at least one wall-mounted post assembly 100, a main frame 200, and at least one connecting assembly 300. The main frame 200 is configured to block an entrance. In this embodiment, an amount of the at least one wall-mounted post assembly 100 is two. The two wall-mounted post assemblies 100 are mounted on two walls on two sides of the entrance. In this embodiment, an amount of the at least one connecting assembly 300 is two. The two connecting assemblies 300 are respectively mounted on two ends of the main frame 200. Each one of the connecting assemblies 300 is detachably and rotatably connected to a corresponding one of the wall-mounted post assemblies 100. Please also refer to FIG. 2: the safety gate 10 comprises two stopping assemblies 400. Each one of the stopping assemblies 400 is mounted on a side of a corresponding one of the wall-mounted post assemblies 100. Said side of the wall-mounted post assembly 100 is close to the main frame 200. Each one of the stopping assemblies 400 is capable of extending elastically in the corresponding wall-mounted post assembly 100 and thereby is configured to limit the connecting assembly 300 connected on the corresponding wall-mounted post assembly 100 in position.

In this embodiment, with the connecting assemblies connected to the wall-mounted post assemblies 100, the main frame 200 is fixed on the wall-mounted post assemblies 100. After the connecting assemblies 300 are mounted on the wall-mounted post assemblies 100, each one of the stopping assemblies 400 can extend out of the corresponding wall-mounted post assembly 100 for limiting the corresponding connecting assembly 300. Therefore, the stopping assemblies 400 can prevent the connecting assemblies 300 from detaching from the wall-mounted post assemblies 100 so that the main frame 200 is fixed on the wall-mounted post assemblies 100 to block the entrance. When someone wants to pass through the entrance, he only needs to press either one of the stopping assemblies 400 to withdraw back to the corresponding wall-mounted post assembly 100. Then, the corresponding connecting assembly 300 can be separated from the corresponding wall-mounted post assembly 100 and thus the main frame 200 separates from said corresponding wall-mounted post assembly 100 and is capable of pivoting about the other wall-mounted post assembly 100 to open the entrance. When detaching the main frame 200 from the entrance, a user only needs to press both two stopping assemblies 400 to withdraw into the wall-mounted post assemblies 100, and then both two connecting assemblies 300 can detach from the corresponding wall-mounted post assemblies 100, so that the main frame 200 completely detaches from the two wall-mounted post assemblies 100. Therefore, the safety gate 10 of the present invention is easy to be opened for passing through and to be detached as well.

In a preferred embodiment, the main frame 200 comprises a first frame portion 210 and a second frame portion 220. The first frame portion 210 and the second frame portion 220 are pivotal with respect to each other. Precisely, at least one pivot assembly 500 is mounted at where the first frame portion 210 and the second frame portion 220. With the pivot assembly 500, the first frame portion 210 and the second frame portion 220 are capable of pivoting to any angle with respect to each other, and thereby the safety gate 10 of the present invention can be adapted to two walls or two obstacles separated by difference distances. Besides, if the user wants to keep the entrance open, the first frame portion 210 and the second frame portion 220 can be folded to reduce occupied space.

Figure 3:
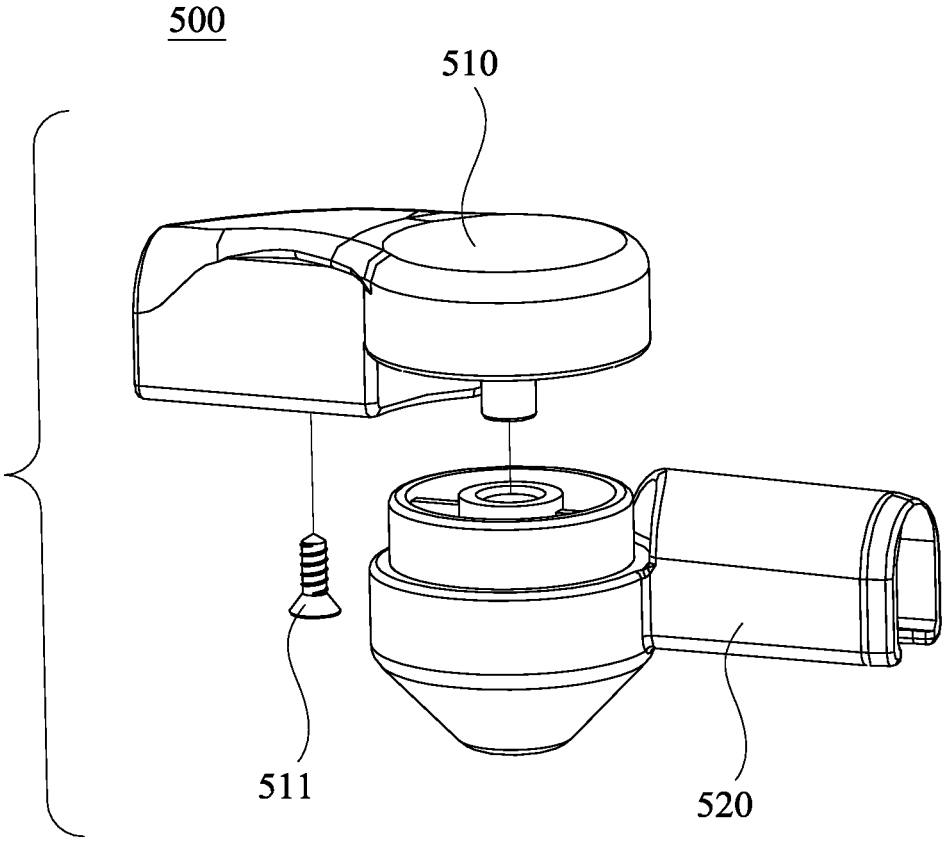
FIG. 3 is an exploded view of a pivot assembly of the safety gate in FIG. 1.

Then please refer to FIG. 1 and FIG. 3. In a preferred embodiment, each one of the at least one pivot assembly 500 comprises a first connecting component 510 and a second connecting component 520. The first connecting component 510 is sleeved on the first frame portion 210 and near an end of the second frame portion 220. The first connecting component 510 is fixed on the first frame portion 210 via a first screwed fixture 511. The second connecting component 520 is sleeved on the second frame portion 220 and near one end of the first frame portion 210. The second connecting component 520 is fixed on the second frame portion 220 via a second screwed fixture (not shown in the drawings). The first connecting component 510 and the second connecting component 520 are pivotally connected to each other and configured to allow the first frame portion 210 and the second frame portion 220 to pivot with respect to each other.

Precisely, the first frame portion 210 comprises a first lateral rod 211, a second lateral rod 213, and a plurality of first support rods 215. Two ends of each one of the first support rods 215 are respectively connected to the first lateral rod 211 and the second lateral rod 213. The second frame portion 220 comprises a third lateral rod 221, a fourth lateral rod 223, and a plurality of second support rods 225. Two ends of each one of the second support rods 225 are respectively connected to the third lateral rod 221 and the fourth lateral rod 223.

Figure 4:
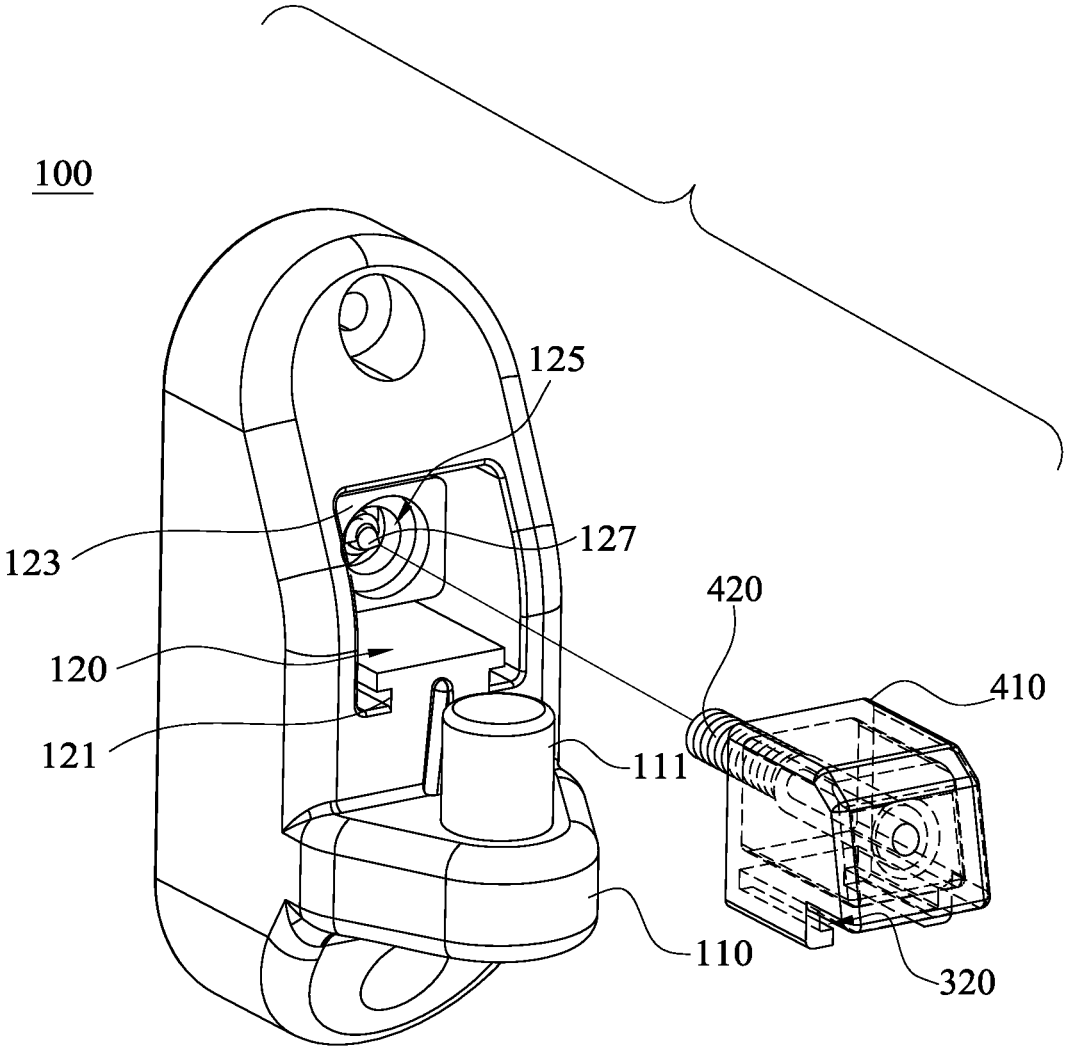
FIG. 4 is an exploded view of a stopping assembly of the safety gate in FIG. 1.
Figure 5:
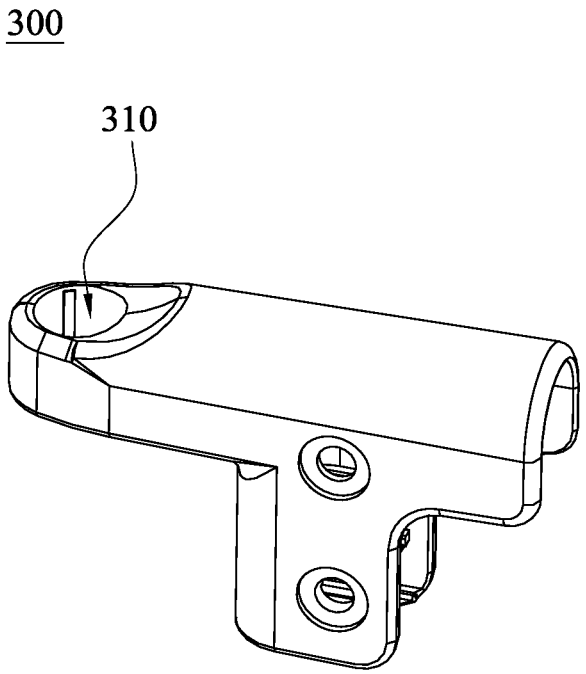
FIG. 5 is a perspective view of a connecting assembly of the safety gate in FIG. 1.

Then please refer to FIG. 4. In a preferred embodiment, a seat 110 is mounted on a side, near the main frame 200, of the wall-mounted post assembly 100. A connecting post 111 is mounted on the seat 110. Then also please refer to FIG. 5. The connecting assembly 300 forms a connecting hole 310. The connecting hole 310 is sleeved on the connecting post 111, which causes the connecting assembly 300 to be separated from the wall-mounted post assembly 100 easier. The connecting assembly 300 is capable of pivoting around the connecting post 111. When someone wants to pass through the entrance, after one of the connecting assemblies 300 is separated from the connecting post 111, said connecting assembly 300 can be pivoted to the wall-mounted post assembly 100 at another side of the entrance. Therefore, the entrance is opened and thereby the user can pass through.

In a preferred embodiment, each one of the wall-mounted post assembly 100 forms an installing chamber 120. The installing chamber 120 is configured to receive one of the stopping assemblies 400. Each one of the stopping assemblies 400 comprises a stopping block 410 and an elastic component 420. One end of the elastic component 420 is mounted in the installing chamber 120 and another end of the elastic component 420 is connected to the stopping block 410. The stopping block 410 and the seat 110 are spaced from each other. Then please refer to FIG. 2. The elastic component 420 exerts an elastic force on the stopping block 410, which limits the connecting assembly 300 between the stopping block 410 and the seat 110 by the stopping block 410 and prevents the connecting assembly 300 from being detached from the connecting post 111.

Specifically, when the user wants to open the safety gate 10, the user may press the stopping block 410 to move the stopping block 410 away from the corresponding connecting assembly 300. After the stopping block 410 withdraws into the installing chamber 120, the user can lift the connecting assembly 300 to separate from the connecting post 111, and thereby the first frame portion 210 or the second frame portion 220 is detached from the corresponding wall-mounted post assembly 100. Then, the user pivots the first frame portion 210 or the second frame portion 220 to open the safety gate 10 of the present invention completely.

When the user does not want the safety gate 10 to block the entrance, just like opening the safety gate 10, the user may press the two stopping blocks 410 on both sides at the same time or successively to let the first frame portion 210 separate from the corresponding wall-mounted post assembly 100 and the second frame portion 220 separate from the corresponding wall-mounted post assembly 100. Thus, the main frame 200 can be detached.

When the user wants to mount the main frame 200 on the wall-mounted post assemblies 100, the user can press the stopping blocks 410 to respectively move away from the corresponding connecting assemblies 300 so that the stopping blocks 410 withdraw into the corresponding installing chambers 120. Then, the user respectively sleeves the connecting assemblies 300 on the connecting posts 111 and releases the stopping blocks 410, such that the stopping blocks 410 moves toward the corresponding connecting assembly 300 via the elastic components 420 and extend out of the corresponding installing chambers 120. Therefore, the connecting assemblies 300 are limited between the stopping blocks 410 and the corresponding seats 110. In other words, the connecting assemblies 300 are fixed, i.e., the first frame portion 210 and the second frame portion 220 are respectively locked on the corresponding wall-mounted post assemblies 100, the thereby the safety gate is installed completely.

Figure 6:
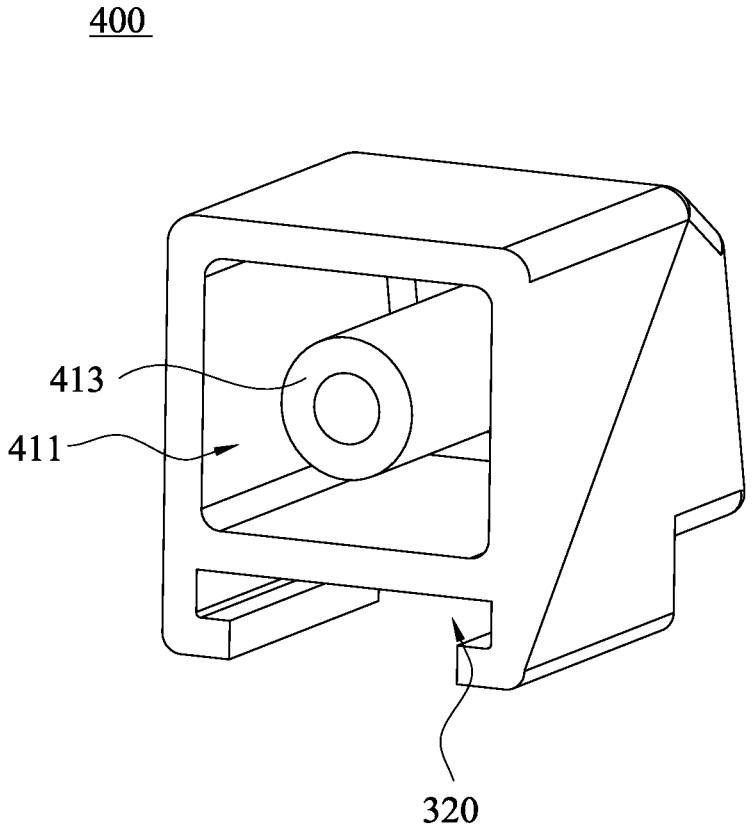
FIG. 6 is a perspective view of a stopping block of the connecting assembly in FIG. 4.

Then please refer to FIG. 4 and FIG. 6. In a preferred embodiment, each one of the installing chambers 120 comprises a guiding track 121 on a bottom surface of the installing chamber 120. Each one of the stopping blocks 410 comprises a slide slot 430 connected to the guiding track 121. The slide slot 320 is capable of sliding with respect to the connected guiding track 121, which guides the guiding block 410 during moving in the installing chamber 120 and will not deviate.

Further, each one of the stopping blocks 410 forms a guiding chamber 411 and each one of the installing chambers 120 comprises a guiding block 123 therein. The sectional shape and sectional size of the guiding block 123 and the sectional shape and sectional size of the guiding chamber 411 are the same. Each one of the elastic components 420 connects one of the guiding chambers 411 and one of the guiding blocks 123. The guiding chamber 411 and the guiding block 123 are configured to guide the stopping block 410 together, which prevents the stopping block 410 from deviating from a predetermined direction during movement. Therefore, the stopping block 410 can be moved in the installing chamber 120 stably.

In a preferred embodiment, the guiding block 123 comprises an installing hole 125 and a first guiding component 127. The first guiding component 127 is mounted in the installing hole 125. The stopping blocks 410 each comprise a second guiding component 413 in the guiding chamber 411. One end of the elastic component 420 is mounted on the first guiding component 127 and another end of the elastic component 420 is mounted on the second guiding component 413, which guides the elastic component 420 and prevents the elastic component 420 from being bent during compression or stretching.

Figure 7:
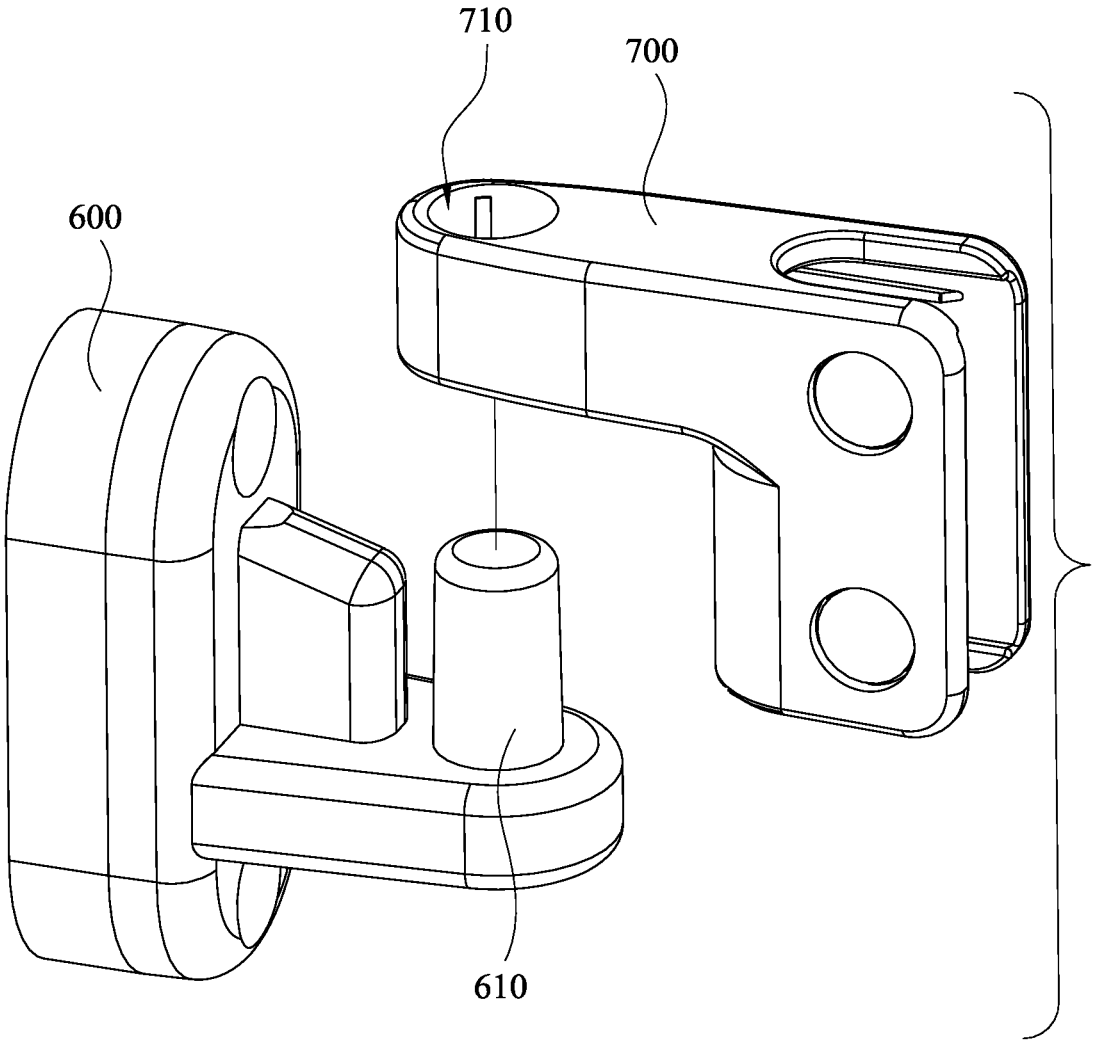
FIG. 7 a perspective view of a first auxiliary connecting assembly and a second auxiliary connecting assembly of the safety gate in FIG. 1.

Then please refer to FIG. 1 and FIG. 7. In a preferred embodiment, the safety gate 10 of the present invention further comprises at least one first auxiliary connecting assembly 600 and at least one second auxiliary connecting assembly 700. Each one of the at least one first auxiliary connecting assembly 600 and one of the wall-mounted post assemblies 100 are spaced from each other and located in the same vertical line. Each one of the at least one second auxiliary connecting assembly 700 is mounted on the main frame 200 and spaced from the connecting assembly 300 in another vertical line. The at least one first auxiliary connecting assembly 600 and the at least one second auxiliary connecting assembly 700 are pivotally and detachably connected to each other. In addition, each one of the at least one first auxiliary connecting assembly 600 comprises an auxiliary column 610, and each one of the at least one second auxiliary connecting assembly 700 forms an auxiliary hole 710. The auxiliary hole 710 is sleeved on the auxiliary column 610. With the auxiliary column 610 sleeved in the auxiliary hole 710, the main frame 200 can be fixed on the wall-mounted post assemblies 100 more stably. Precisely, an amount of the at least one first auxiliary connecting assembly 600 is two. The two first auxiliary connecting assemblies 600 are mounted on the two walls of the entrance respectively and spaced from the two wall-mounted post assemblies 100. An amount of the at least one second auxiliary connecting assembly 700 is two. The two second auxiliary connecting assemblies 700 are respectively mounted on the first support rod 215 and the second support rod 225 and configured to stabilize the first frame portion 210 and the second frame portion 220. In another embodiment, the amounts of the first auxiliary connecting assembly 600 and the second auxiliary connecting assembly 700 are not limited thereto.

Then please refer to FIG. 1. In a preferred embodiment, the safety gate 10 may comprise a wheel 800. The wheel 800 is mounted on a side, away from the connecting assembly 300, of the main frame 200, which reduces the resistance of the main frame 200 during opening or closing. Precisely, the safety gate 10 may have multiple wheels 800 respectively mounted to one end, close to the corresponding wall-mounted post assembly 100, of the second lateral rod 213, and one end, close to the other corresponding wall-mounted post assembly 100, of the fourth lateral rod 223, and a portion where the second lateral rod 213 and the fourth lateral rod 223 are connected.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A safety gate configured to be mounted at an entrance and comprising:

two wall-mounted post assemblies respectively mounted on two walls on two sides of the entrance;

a main frame;

two connecting assemblies respectively mounted on two ends of the main frame; each one of the connecting assemblies detachably and rotatably connected to a corresponding one of the wall-mounted post assemblies; and two stopping assemblies respectively mounted on the two wall-mounted post assemblies, and respectively limiting the two connecting assemblies; each one of the stopping assemblies mounted on a side, close to the main frame, of the corresponding wall-mounted post assembly; each one of the stopping assemblies capable of extending elastically in the corresponding wall-mounted post assembly thereby configured to limit the corresponding connecting assembly.

2. The safety gate as claimed in claim 1, wherein the main frame comprises:

a first frame portion;

a second frame portion tiltably mounted on the first frame portion; and an angle between the first frame portion and the second frame portion being from 0° to 180°.

3. The safety gate as claimed in claim 2, wherein:

each one of the wall-mounted post assemblies comprises:

a seat on a side, close to the main frame, of said wall-mounted post assembly; and a connecting post on the seat;

each one of the connecting assemblies comprises:

a connecting hole; the connecting post of each one of the wall-mounted post assemblies mounted in the connecting hole of the corresponding connecting assembly.

4. The safety gate as claimed in claim 3, wherein:

each one of the wall-mounted post assemblies forms:

an installing chamber configured to receive the corresponding stopping assembly;

each one of the stopping assemblies comprises:

a stopping block spaced from the seat and configured to limit said one of the connecting assemblies between the stopping block and the seat; and an elastic component, one of two ends of the elastic component mounted in the installing chamber of the corresponding wall-mounted post assembly and another one of the two ends of the elastic component connected to said stopping block so that an elastic force of the elastic component is exerted on said stopping block.

5. The safety gate as claimed in claim 4, wherein:

the installing chamber of each one of the wall-mounted post assemblies comprises:

a guiding track at a bottom surface of installing chamber; and the stopping block of each one of the stopping assemblies comprises:

a slide slot connected to the guiding track of the corresponding wall-mounted post assembly and capable of slipping with respect to said guiding track.

6. The safety gate as claimed in claim 4, wherein the stopping block of each one of the stopping assemblies comprises:

a guiding chamber;

each one of the wall-mounted post assemblies comprises:

a guiding block in the installing chamber and matching the guiding chamber of the corresponding stopping assembly in shape;

the elastic component of each one of the stopping assemblies connecting the guiding chamber of said stopping assemblies and the guiding block of the corresponding wall-mounted post assemblies.

7. The safety gate as claimed in claim 6, wherein:

the guiding block of each one of the wall-mounted post assemblies comprises:

an installing hole; and a first guiding component mounted in the installing hole; and each one of the stopping assemblies comprises:

a second guiding component mounted in the guiding chamber;

the two ends of the elastic component respectively sleeved on the first guiding component and the second guiding component.

8. The safety gate as claimed in claim 2, wherein:

the first frame portion comprises:

a first lateral rod;

a second lateral rod; and a plurality of first support rods, two ends of each one of the first support rods respectively connected to the first lateral rod and the second lateral rod;

the second frame portion comprises:

a third lateral rod;

a fourth lateral rod; and a plurality of second support rods, two ends of each one of the second support rods respectively connected to the third lateral rod and the fourth lateral rod; and the two connecting assemblies respectively mounted on one end of the first lateral rod and one end of the second lateral rod.

9. The safety gate as claimed in claim 2 further comprising:

at least one first auxiliary connecting assembly vertically spaced from one of the wall-mounted post assemblies; and at least one second auxiliary connecting assembly mounted on the main frame and vertically spaced from one of the connecting assemblies; the at least one second auxiliary connecting assembly detachably and rotatably connected to the at least one first auxiliary connecting assembly.

10. The safety gate as claimed in claim 9, wherein:

the at least one first auxiliary connecting assembly includes two said first auxiliary connecting assemblies respectively spaced from the two wall-mounted post assemblies; and the at least one second auxiliary connecting assembly includes two said second auxiliary connecting assemblies respectively mounted on the first frame portion and the second frame portion; each one of the two second auxiliary connecting assemblies detachably and rotatably connected to a respective one of the first auxiliary connecting assemblies.

11. The safety gate as claimed in claim 2 further comprising:

a wheel mounted on a side, away from the connecting assemblies, of the main frame.

12. The safety gate as claimed in claim 1, wherein:

each one of the wall-mounted post assemblies comprises:

a seat on a side, close to the main frame, of said wall-mounted post assembly; and a connecting post on the seat;

each one of the connecting assemblies comprises:

a connecting hole; the connecting post of each one of the wall-mounted post assemblies mounted in the connecting hole of the corresponding connecting assembly.

13. The safety gate as claimed in claim 1, wherein:

each one of the wall-mounted post assemblies forms:

an installing chamber configured to receive the corresponding stopping assembly;

each one of the stopping assemblies comprises:

a stopping block; and an elastic component, one of two ends of the elastic component mounted in the installing chamber of the corresponding wall-mounted post assembly and another one of the two ends of the elastic component connected to the stopping block so that an elastic force of the elastic component is exerted on the stopping block.

14. The safety gate as claimed in claim 13, wherein:

the installing chamber of each one of the wall-mounted post assemblies comprises:

a guiding track at a bottom surface of installing chamber; and the stopping block of each one of the stopping assemblies comprises:

a slide slot connected to the guiding track of the corresponding wall-mounted post assembly and capable of slipping with respect to said guiding track.

15. The safety gate as claimed in claim 13, wherein:

the stopping block of each one of the stopping assemblies comprises:

a guiding chamber;

each one of the wall-mounted post assemblies comprises:

a guiding block in the installing chamber and matching the guiding chamber of the corresponding stopping assembly in shape;

the elastic component of each one of the stopping assemblies connecting the guiding chamber of said stopping assemblies and the guiding block of the corresponding wall-mounted post assemblies.

16. The safety gate as claimed in claim 15, wherein:

the guiding block of each one of the wall-mounted post assemblies comprises:

an installing hole; and a first guiding component mounted in the installing hole; and each one of the stopping assemblies comprises:

a second guiding component mounted in the guiding chamber;

the two ends of the elastic component respectively sleeved on the first guiding component and the second guiding component.

17. The safety gate as claimed in claim 1 further comprising:

at least one first auxiliary connecting assembly vertically spaced from one of the wall-mounted post assemblies; and at least one second auxiliary connecting assembly mounted on the main frame and vertically spaced from one of the connecting assemblies; the at least one second auxiliary connecting assembly detachably and rotatably connected to the at least one first auxiliary connecting assembly.

18. The safety gate as claimed in claim 17, wherein:

the at least one first auxiliary connecting assembly includes two said first auxiliary connecting assemblies respectively spaced from the two wall-mounted post assemblies; and the at least one second auxiliary connecting assembly includes two said second auxiliary connecting assemblies respectively mounted on the first frame portion and the second frame portion; each one of the two second auxiliary connecting assemblies detachably and rotatably connected to a respective one of the first auxiliary connecting assemblies.

19. The safety gate as claimed in claim 1 further comprising:

a wheel mounted on a side, away from the connecting assemblies, of the main frame.

* * * * *